United States Patent [19]

Adrian et al.

[11] 4,150,267

[45] Apr. 17, 1979

[54] MASTER ELECTRIC SWITCH

[76] Inventors: Melvin Adrian, c/o George Spector, 3615 Woolworth Bldg., 233 Broadway; George Spector, 3615 Woolworth Bldg., 233 Broadway, both of New York, N.Y. 10007

[21] Appl. No.: 656,092

[22] Filed: Feb. 9, 1976

[51] Int. Cl.[2] ..... H01H 35/14

[52] U.S. Cl. ..... 200/61.47; 200/52 A; 200/61.52; 200/153 A; 200/161; 200/220; 180/104; 340/61

[58] Field of Search ..... 200/52 A, 64.47, 61.52, 200/61.53, 61.77, 153 A, 153 F, 153 K, 153 N, 156, 161, 220; 307/10 R, 10 BP; 180/103 T, 104; 340/61

[56] References Cited

U.S. PATENT DOCUMENTS

| | | | |
|---|---|---|---|
| 2,207,406 | 7/1940 | Jones | 200/220 X |
| 2,523,215 | 9/1950 | Irvine | 200/161 X |
| 2,545,965 | 3/1951 | McCamon | 200/161 |
| 2,599,745 | 8/1971 | Houglics | 180/104 |
| 2,786,921 | 3/1957 | List | 200/161 |
| 2,803,725 | 8/1957 | Ott | 200/161 |
| 2,853,627 | 9/1958 | Karl | 200/161 X |
| 2,861,073 | 11/1958 | Brutscher, Sr. et al. | 200/61.47 X |
| 2,917,611 | 12/1959 | Houston | 200/161 |
| 2,986,614 | 5/1961 | Minch | 200/61.52 X |
| 2,986,616 | 5/1961 | Hanserd | 200/61.52 |
| 3,571,538 | 3/1971 | Swanson | 200/61.47 |
| 3,743,802 | 7/1973 | Avenick | 200/61.47 |
| 3,760,353 | 9/1973 | Hassinger | 200/64.47 X |
| 3,871,473 | 3/1975 | Castonguay | 180/104 |

FOREIGN PATENT DOCUMENTS

| | | | |
|---|---|---|---|
| 623075 | 3/1927 | France | 200/61.52 |
| 639041 | 3/1928 | France | 200/61.52 |
| 705236 | 3/1931 | France | 200/161 |
| 980090 | 12/1950 | France | 200/161 |

*Primary Examiner*—Volodymyr Y. Mayewsky

[57] ABSTRACT

A special switch installed within an automotive vehicle between the battery and the vehicle electric system, so that when the special switch is turned off, the vehicle battery is completely disconnected, thus eliminating all danger of a fire starting in case a short circuit occurs anywhere in the system; the special switch consisting, in one form of the invention, of an ordinary heavy duty switch inside the engine compartment that can be manually disconnected by a flexible cable extending through the fire wall to a pull knob located conveniently to the vehicle driver.

1 Claim, 6 Drawing Figures

Fig. 1
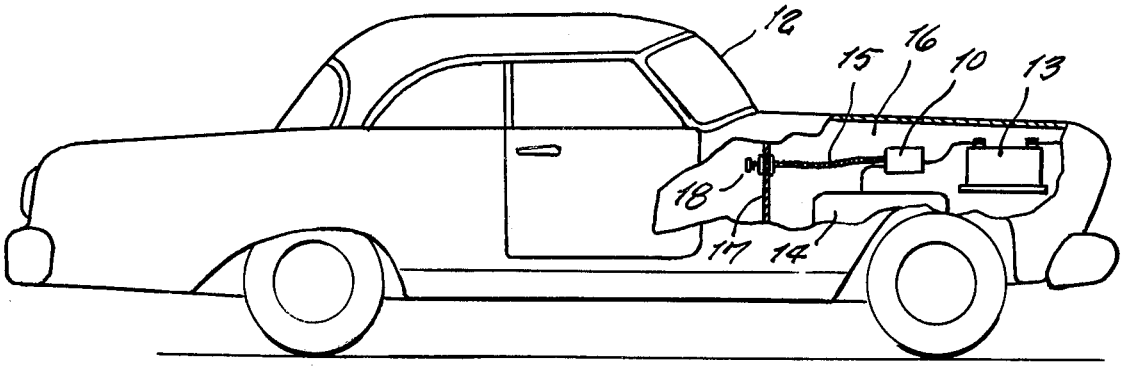
Fig. 2
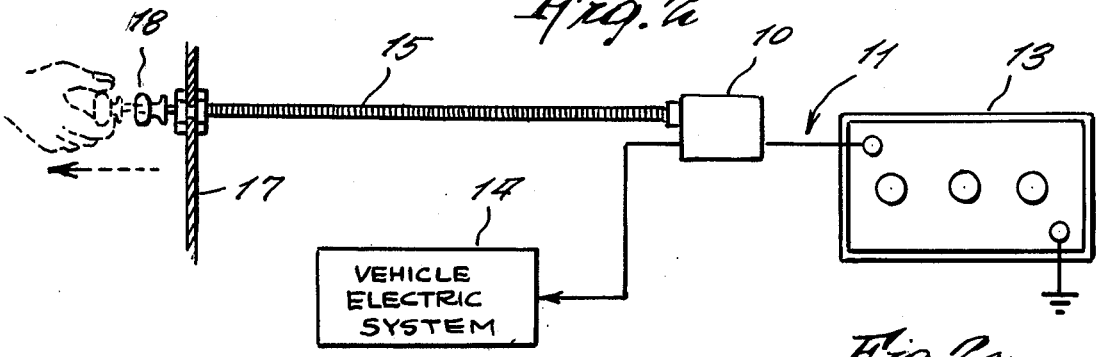
Fig. 2a
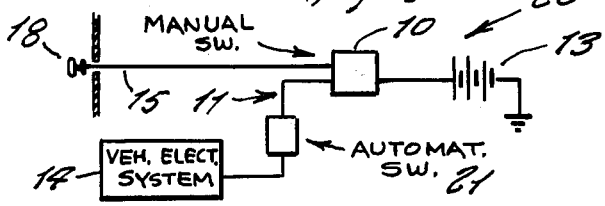
Fig. 3
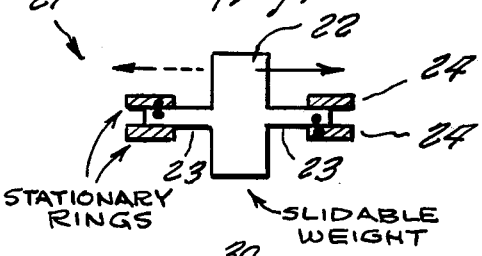
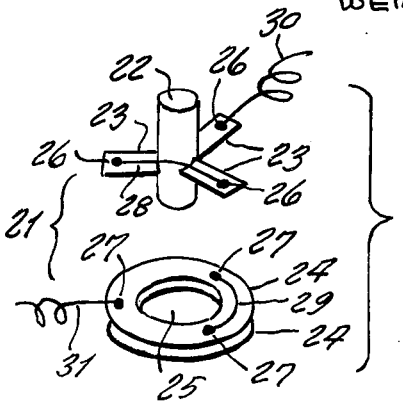
Fig. 4
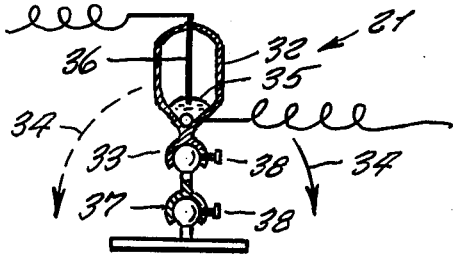
Fig. 5

MASTER ELECTRIC SWITCH

This invention relates generally to automotive vehicle safety devices.

It is well known through statistics that a great many vehicles each year catch on fire, while being unattended, due to short circuits that develop. This situation is, of course, very serious and is, therefore, in want of an improvement.

Accordingly, it is a principal object of the present invention to provide a master electric switch that can be installed in the automotive vehicle between the battery and the vehicle electric system so that in case a failure occurs anywhere in the system and a short circuit occurs, there is then no danger of a fire starting.

Another object accordingly, is to provide a master electric switch that would thus protect not only the vehicle from distruction, but also protect any cargo or objects contained therein, such as valuable objects left within a car, a freight in a truck, or a load of hay or field grain near a tractor or combine, as well as prevent a garage or barn containing the vehicle from catching on fire.

Still another object is to provide a master electric switch which in modified designs of the invention, will automatically disconnect upon the impact of a collision, because a motoriest may not be conscious enough to manually disconnect the switch.

Other objects are to provide a master electric switch which is simple in design, inexpensive to manufacture, rugged in construction, easy to use and efficient in operation.

These and other objects will be readily apparent upon a study of the following specification and the accompanying drawing wherein:

FIG. 1 is a side view of an automobile shown partly broken away so to illustrate the present invention installed therein.

FIG. 2 is an electrical diagram thereof.

FIG. 2*a* is a diagram similar to FIG. 2 which additionally includes an automatic switch that works without need of being activated by a person, so that it would be ideal in case of a violent crash wherein an occupant of the vehicle may be made unconscious so would not be aware of pulling the manual switch.

FIG. 3 is a diagramatic side view of the operative components of the automatic switch, and wherein a violent crash from any direction would automatically cause a weight to shift from its position so to break an electric circuit.

FIG. 4 is a view of the components of FIG. 3.

FIG. 5 is a diagramatic view of another modified design of automatic switch that is also operative in any direction, and includes a mercury switch on a pivotable post.

Referring now to the drawing in detail, and more particularly to FIGS. 1 and 2 at this time, the reference numeral 10 represents a master electric switch according to the present invention wherein the same is installed in an electric circuit 11 of an automotive vehicle 12 where it intercepts the circuit between the battery 13 and the vehicle electric system 14.

The master electric switch 10 is of heavy duty 100 amp. on-off type and is located approximately 2 to 4 inches away from the battery and is in series with the battery and the electric system 14. The switch is manually controlled by a sheathed flexible cable 15 that is connected at one end to the switch 10 located inside engine compartment 16, and the other end of the cable extends through the fire wall 17 and is fitted with a knob 18 located comfortably to a driver so that he may pull the same when wishing to disconnect the electric system from the battery.

In FIG. 2*a* a modified design of the invention 20 also includes an additional automatic switch 21 that automatically disconnects the vehicle electric system from the battery in case the driver is incapacitated to do so, such as in a head on collision when a driver may be knocked unconscious.

In FIGS. 3 and 4, a specific design of automatic switch 21 is shown which consists of a non-conductive weight 22 having sidewardly extending equally spread apart arms 23 which are frictionally supported between a pair of non-conductive rings 24. A central opening 25 of the rings is sufficiently larger than the body of the weight so to permit the weight and its integral arms to slide or shift from a concentric position and into any direction, due to momentum, in case of a sudden impact against the vehicle from any direction, such as in a collision. The arms 23 each has an electric contact 26 that normally engages on of three contacts 27 on one of the rings when the weight is concentrically positioned and correctly turned in the opening 25. A conductor 28 runs between two of the contacts 26, and a conductor 29 runs between two of the contacts 27 so to make a continuous electric circuit between an outside conductor 30 connected to the third contact 26 and an outside conductor 31 connected to the third contact 27. It is now apparent that a shift of the weight in any direction will thus automatically break the circuit. The switch 21 is installed in the vehicle with the rings 24 being stationarily mounted while the weight is free to shift.

In FIG. 5 another design of automatic switch 21 consists of mercury switch 32 mounted freely pivotable on ball and socket joint 33 and in an upstanding position so that an impact against the vehicle will cause it to pivot downward in any direction as indicated by arrows 34, so to break contact between a pool of mercury 35 and electrode 36. A second ball and socket joint 37 insures tilting to at least 90 or more degrees. Set screws 38 adjust the frictional tension between the ball and socket members of the joint.

Thus modified designs of the invention are provided.

While various changes may be made in the detail construction, it is understood that such changes will be within the spirit and scope of the present invention as is defined by the appended claims.

What is claimed is:

1. In a vehicular electric system having an electric circuit, the combination of two electric switches in series with the storage battery, wherein one of said switches is manually operated and the other switch is actuated to the off position upon vehicular impact, the first said switch including an external cable extending through the usual vehicle dashboard and provided with an actuating knob accessible to the operator and wherein the second said switch comprises a housing movably mounted on a non-moving rigid support whereby said housing moves relative to said support upon vehicular impact, said housing containing a pair of spaced electrical contacts and mercury normally electrically connecting said contacts, one of said contacts comprising a vertical electrode axially aligned with the vertical axis of said housing and vertically spaced from the other said contact, both of said contacts being electrically connected by wiring to the electric circuit, whereby said housing and support are adjustably connected with ball and socket joints for universal movement of the housing, wherein the other said contact is vertically disposed beneath the electrode in a trough found at the bottom of said housing, said housing being sealed and found of electrically insulating material, whereby vehicular impact causes movement of the housing from a normal vertical position to a horizontal position resulting in shifting of the mercury and breaking of electrical contact between the electrodes, and thereby electrically disconnecting said system.

* * * * *